US007386964B2

(12) United States Patent
Kuru et al.

(10) Patent No.: US 7,386,964 B2
(45) **Date of Patent: *Jun. 17, 2008**

(54) SHEET PROCESSING APPARATUS CAPABLE OF PROCESSING CONVEYING JAM

(75) Inventors: Ayumu Kuru, Kanagawa-ken (JP); Toru Otsuka, Kanagawa-ken (JP); Takahito Shinfuku, Chiba-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 150 days.

This patent is subject to a terminal disclaimer.

(21) Appl. No.: 11/228,249

(22) Filed: Sep. 19, 2005

(65) Prior Publication Data

US 2006/0006594 A1 Jan. 12, 2006

Related U.S. Application Data

(63) Continuation of application No. 10/753,457, filed on Jan. 9, 2004, now Pat. No. 7,017,902.

(30) Foreign Application Priority Data

Jan. 21, 2003 (JP) ..... 2003-012595

(51) Int. Cl.
*B65B 57/10* (2006.01)
*B65B 27/08* (2006.01)
*B65H 7/02* (2006.01)

(52) U.S. Cl. ..... 53/54; 53/582; 209/534; 271/258.01; 271/258.02; 271/259

(58) Field of Classification Search ..... 53/399, 53/582, 587–589, 54, 494, 498, 500; 209/534; 271/259, 258.02, 258.01, 256
See application file for complete search history.

(56) References Cited

U.S. PATENT DOCUMENTS 4,334,619 A * 6/1982 Horino et al. ..... 209/551
4,376,364 A * 3/1983 Horino et al. ..... 53/54

(Continued)

FOREIGN PATENT DOCUMENTS

DE 29 16 119 A1 10/1979

(Continued)

OTHER PUBLICATIONS

European Search Report dated Oct. 22, 2007 for corresponding Application No. EP 03 03 0010.

*Primary Examiner*—Stephen F. Gerrity
(74) *Attorney, Agent, or Firm*—Pillsbury Winthrop Shaw Pittman, LLP

(57) ABSTRACT

A sheet processing apparatus comprises an upper unit, a lower unit and a banding unit. When sheets being conveyed are jammed in the upper unit, the upper unit is stopped and the processes of the lower unit and the banding unit are continuously executed. After the upper unit is stopped, sheets that may possibly be conveyed into the lower unit by inertia are rejected in a safety pocket.

1 Claim, 10 Drawing Sheets

U.S. PATENT DOCUMENTS 4,483,124 A * 11/1984 Ohba et al. ..... 53/54
4,825,378 A 4/1989 Yuge
4,905,840 A * 3/1990 Yuge et al. ..... 209/534
5,035,412 A 7/1991 Hiroi et al.
5,247,159 A 9/1993 Yuge et al.
5,464,099 A 11/1995 Stevens et al.
5,584,477 A 12/1996 Sakai
5,963,755 A 10/1999 Ueda et al.
6,460,705 B1 * 10/2002 Hallowell ..... 209/534
6,550,621 B2 * 4/2003 Fukatsu et al. ..... 209/534
6,782,987 B1 8/2004 Abe et al.
6,860,375 B2 * 3/2005 Hallowell et al. ..... 194/328
7,017,902 B2 * 3/2006 Kuru et al. ..... 271/258.02
2002/0153291 A1 * 10/2002 Otsuka ..... 209/534

FOREIGN PATENT DOCUMENTS

JP 60-218247 A 10/1985
JP 2001-93026 4/2001
JP 2001-93026 A 4/2001

* cited by examiner

SHEET PROCESSING APPARATUS CAPABLE OF PROCESSING CONVEYING JAM

CROSS REFERENCE TO RELATED APPLICATION

This application is a continuation of U.S. application Ser. No. 10/753,457, filed Jan. 9, 2004, now U.S. Pat. No. 7,017,902 which is based upon and claims the benefit of priority from the prior Japanese Patent Application No. 2003-012595, filed Jan. 21, 2003, the entire contents of all of which are incorporated herein by reference.

BACKGROUND OF THE INVENTION

1. Field of the Invention

This invention relates to a sheet processing apparatus and a processing method to take out plural sheets on a transport path one by one detect, classify and stack based on the detection result.

2. Description of the Related Art

A sheet processing apparatus that feeds plural sheets one by one on a transport path, detects them, judges classifications, and based on this judging results, classifies and stacks sheets is so far known as disclosed in Japanese Patent Publication No. 2001-93026.

On a transport path, there are provided plural sensors, the conveying state and conveying a CPU monitors positions of all sheets taken out on a transport path.

When sheets being conveyed are jammed in this apparatus, the operations of the entire apparatus are once operator removes suspended and jammed sheets from the processor.

Two sensors provided on a transport path detect the jamming of sheets. That is, the number of sheets passed each of the sensors are counted by a CPU and if there is a difference between the number of sheets counted by a sensor provided at the upper stream side along the transport path and the number of sheets counted by a sensor provided at the downstream side, the CPU judges that there is the jamming of sheets between two sensors.

Then, when the jam releasing process and the initializing process are executed by operator after removing jammed sheets, the number of sheets passed the sensor at the downstream side is decided and the sheets are conveyed to a specified destination.

However, when the sheet processing apparatus is suspended to operate simultaneously with the jamming as described above for the slip between a conveyor belt and sheets and inertia of the sheets, there is the possibility for generating new defects such as, for example, conveying gap, shifts and the like even for sheets that are not jammed and to be properly conveyed. When such defects are caused, sheets that should have been conveyed normally by passing through the downstream side sensor may not be normally processed.

Further, when such the uncertain process is decided to be the normal process, serious problems such as erroneous counting, etc. may result.

BRIEF SUMMARY OF THE INVENTION

It is an object of this invention to provide a sheet processing apparatus and a processing method that are capable of executing the error process such as sheet conveying jam certainly and easily.

According to this invention, a sheet processing apparatus is provided, which comprises: a sheet feeding portion to take out plural sheets on a transport path one by one; a first unit including the feeding portion; a second unit connected to the first unit through the transport path; a first conveying mechanism to convey sheets taken out on the transport path from the feeding portion in the first unit through the transport path; a second conveying mechanism to receive sheets conveyed from the first unit by the first conveying mechanism and convey in the second unit through the transport path; a detection portion to detect characteristics of the sheets taken out on the transport path by the feeding portion; classifying/stacking portions to classify the sheets conveyed to the second unit through the transport path based on the results of detection by the detection portion; a first detecting portion to detect the conveying state of the sheets conveyed by the first conveying mechanism; and a controller to control the first conveying mechanism to stop thereof when the jamming of sheet is detected by the first detecting portion and control the second unit to classify and stack sheets conveyed to the second unit in classifying/stacking portions.

Further, according to this invention, a sheet processing method is provided for the sheet processing in a sheet processing apparatus including a sheet feeding portion to take out plural sheets on a transport path one by one, a first unit including the feeding portion, a second unit connected to the first unit through the transport path, a first conveying mechanism to convey the sheets taken out on the transport path by the feeding portion in the first unit, and a second conveying mechanism to receive the sheets conveyed from the first unit by the first conveying mechanism and convey in the second unit through the transport path. This processing method comprises detecting characteristics of the sheets taken out on the transport path by the feeding portion; classifying and stacking the sheets conveyed to the second unit through the transport path based on the result of the detection; detecting the conveying state of the sheets being conveyed by the first conveying mechanism; and stopping the operation of the first conveying mechanism when the sheets being conveyed by the first conveying mechanism are in the jammed state, and classifying and stacking the sheets conveyed to the second unit.

DETAILED DESCRIPTION OF THE INVENTION

Preferred embodiments of this invention will be explained below in detail referring to attached drawings.

Figure 1:
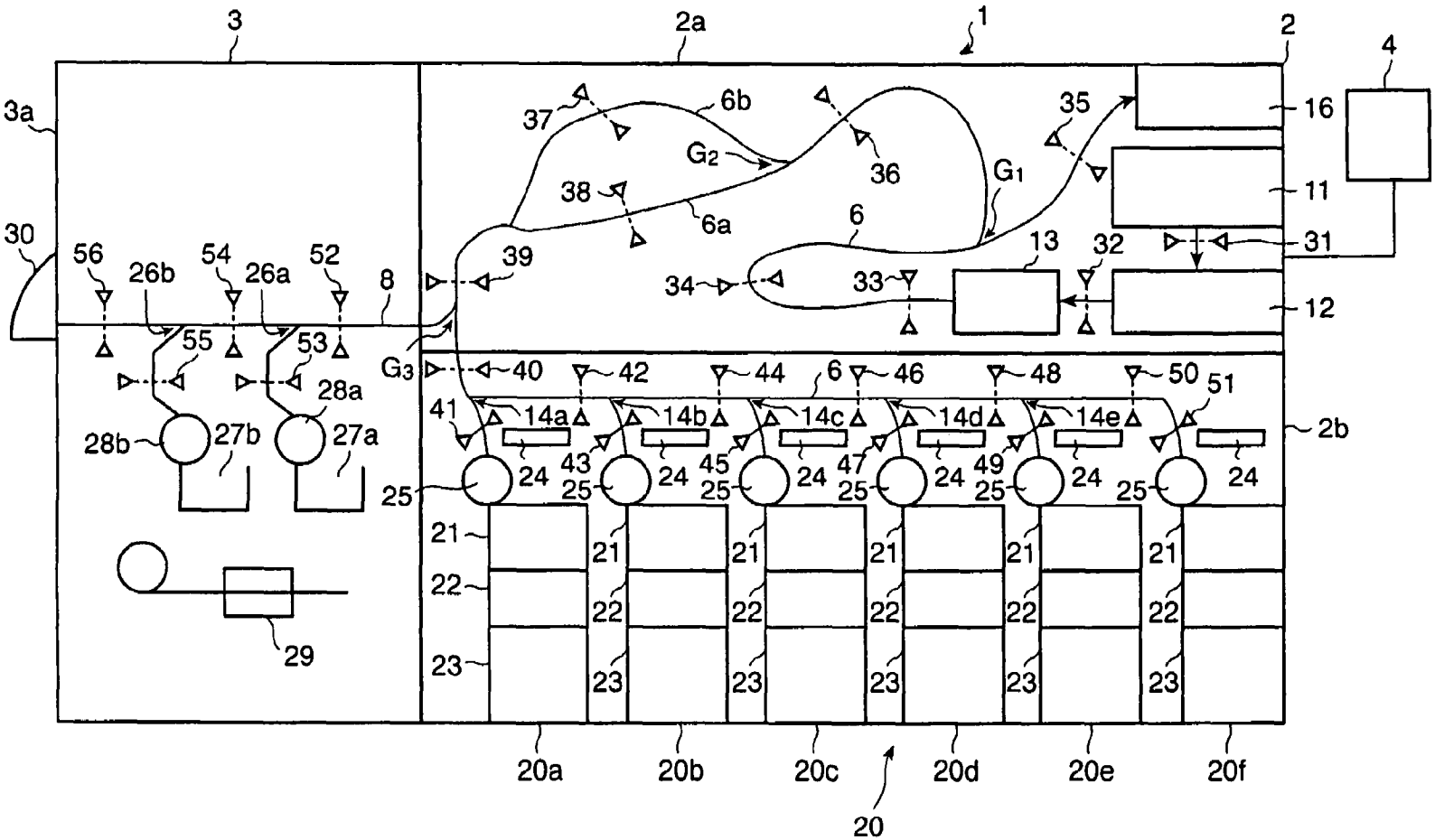
FIG. 1 is a schematic diagram showing the structure of the sheet processing apparatus in the first embodiment of this invention.

FIG. 1 shows the schematic structure of the sheet processing apparatus 1 (hereinafter, referred to processor 1) in a first embodiment.

Processor 1 has a classification/stacking unit 2, a banding unit 3 (a third unit) and an operation display panel 4. Classification/stacking unit 2 has an upper unit 2*a* (a first unit) and a lower unit 2*b* (a second unit). These units 2*a*, 2*b* and 3 have a conveying mechanism to convey sheets independently.

Operation display panel 4 has a touch panel to accept an input operation when operator touches display buttons, and accepts various operational inputs by operator and displays various operational guides for operator. Each of units 2*a*, 2*b* and 3 of processor 1 operates according to work contents that are input and set by operator through operation display unit 4.

Figure 2:
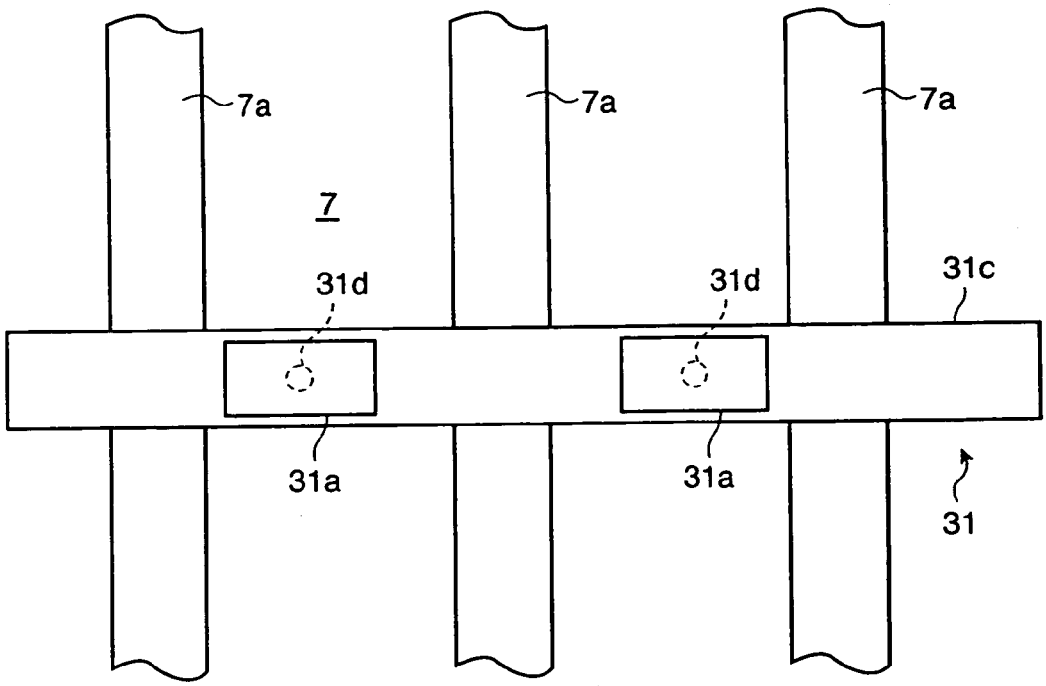
FIG. 2 is a side view of sensors incorporated in the sheet processing apparatus shown in FIG. 1.
Figure 3:
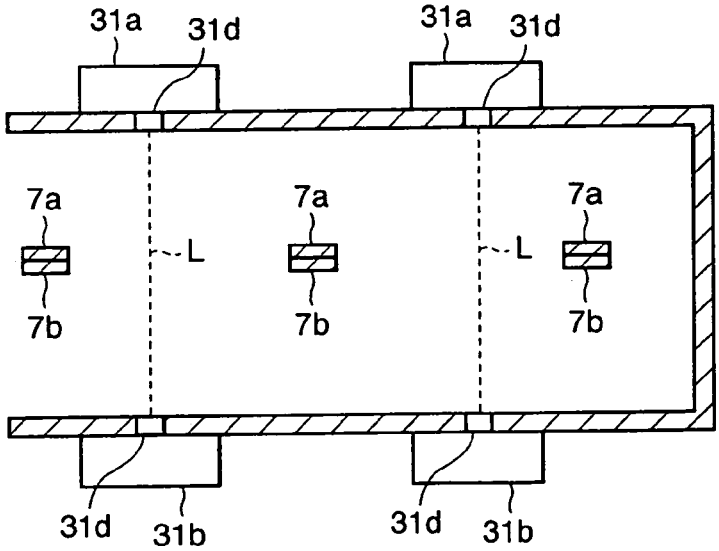
FIG. 3 is a sectional view showing the sensors and conveyor belts shown in FIG. 2.

Upper unit 2*a* has a feeding portion 11 that accepts sheets input for process and feeds sheets one by one on a main transport path 6. Main transport path 6 is extending to a classification/stacking portion 20 of lower unit 2*b* passing through classification/stacking unit 2. Main transport path 6 is defined basically by three sets of conveyor belts 7*a* and 7*b* which are opposed to each other so as to put main transport path between them as shown in FIG. 2 and FIG. 3. Three sets of conveyor belts 7*a* and 7*b* are arranged side by side apart each other in the width direction crossing the conveying direction of sheets and divided properly along main transport path 6. For example, conveyor belts 7*a* and 7*b* of an upper unit 21 and conveyor belts 7*a* and 7*b* of lower unit 2*b* are divided at the boundary portion of upper and lower units 2*a* and 2*b*, and are driven by separate driving motors. Further, sheets are held and conveyed by three sets of conveyor belts 7*a* and 7*b* in the posture with the shorter sides directed in the conveying direction.

On main transport path 6 extending passing through upper unit 2*a* and lower unit 2*b*, there are a alignment portion 12, an detection portion 13, conveyor gates G1, G2 and G3, and five gates 14*a* to 14*e* in order. Three conveyor gates G1, G2 and G3 and five gates 14*a* to 14*e* are switched by a controller 60, which will be described later, based on the result of detection by detection portion 13.

Alignment portion 12 is equipped with plural sensors (not illustrated) that detect the conveying posture of sheets taken out on main transport path 6 by feeding portion 11 and a correction mechanism (not illustrated) that corrects the conveying posture of the taken-out sheets based on the detection results of these plural sensors.

Detecting portion 13 has plural sensors (not illustrated) to detects characteristics of sheets of which conveying postures are corrected by alignment portion 12 and a judging portion (not illustrated) to judge conveying destinations of sheets based on characteristics detected from the taken-out sheets by these plural sensors. Various kinds of characteristics are tear, stain, bend, right or false, conveying form, conveying direction, kinds of sheets and the like.

Conveyor gate G1 is switched to selectively lead sheets being conveyed on main transport path 6 to rejection portion 16. Sheets that were judged to be rejected by detection portion 13 out of those sheets taken out on main transport path 6 by feeding portion 11 are sent into rejection portion 16.

Conveyor gate G2 is switched to selectively direct sheets being conveyed on main transport path 6 toward reversing transport path 6*a*. Reversing transport path 6*a* has a structure to twist above-mentioned conveyor belts 7*a* and 7*b* by 180° along their running directions and reverses both sides of sheets. Sheets to bypass reversing transport path 6 pass through bypassing path 6*b*.

Conveyor gate G3 provided near the exit of upper unit 2*a* functions as a diverging gate of this invention to branch main transport path 6 to diverging path 8 that will be described later. Diverging path 8 is extending almost horizontally by passing through banding unit 3 that will be described later.

Five gates 14*a* to 14*e* lead sheets conveyed into lower unit 2*b* on main transport path 6 after passing through conveyor gate G3 to specified stacking portions. Sheet stacking portions are judged in controller 60 by detection portion 13 and gates 14*a* to 14*e* are selectively operated according to the judging result by this detection portion 13.

There are provided six classifying/stacking portions 20*a* to 20*f* as sheet stacking destinations by gates 14*a* to 14*e*. First classifying/stacking portion 20*a* is provided corresponding to gate 14*a* provided at the most upper stream side along main transport path 6. Second classifying/stacking portion 20*b* is provided corresponding to second gate 14*b*. Third classifying/stacking portion 20*c* is provided corresponding to third gate 14*c*. Fourth classifying/stacking portion 20*d* is provided corresponding to fourth gate 14*d*. Fifth classifying/stacking portion 20*e* and sixth classifying/stacking portion 20*f* are provided corresponding to fifth gate 14*e*.

First to sixth classifying/stacking portions 20*a* to 20*f* (hereinafter, may be called classifying/stacking portion 20 generically) have temporal stacking portion 21 for temporarily stacking sheets diverged from main transport path through corresponding gates 14*a* to 14*e* (hereinafter, may be called gate 14 generically), shutter 22 provided at the bottom of temporal stacking portion 21, cassette 23 for receiving sheets dropping from temporal stacking portion 21 through shutter 22, and pusher 24 provided above temporal stacking portion 21, respectively. Pusher 24 functions to push sheets in temporal stacking portion 21 into cassette 23 through shutter 22.

Between gate 14 and temporal stacking portion 21, there are provided bladed wheels 25 for separating sheets from main transport path 6, respectively. Further, each cassette 23 is provided to lower unit 2*b* detachably and can be removed from lower unit 2*b* manually by operator.

On the other hand, on a diverging path 8 extending through banding unit 3, two gates 26*a* and 26*b* are provided. Below diverging path 8, stacking portions 27*a* and 26*b* are provided corresponding to gates 26*a* and 27*b*. When two gates 26*a* and 26*b* are switched selectively, sheets branched from diverging path 8 are separated from diverging path 8 by bladed wheels 28*a* and 28*b* and stacked in corresponding stacking portions 27*a* and 27*b*.

Below two stacking portions 27*a* and 27*b*, there is provided banding portion 29 for receiving sheets stacked in each stacking portion and banding for specified number of sheets. In this embodiment, sheets stacked in stacking portions 27*a* and 27*b* are banded for every 100 sheets with a paper strip by banding portion 29.

Further, there is provided safety pocket 30 (a rejection pocket) that will be described later, on sidewall 3*a* at the wall separated from classifying/stacking unit 2 of banding unit 3. Safety pocket 30 functions as a rejecting portion of this invention jointly with above-mentioned conveyor gate G3.

In addition, three sets of conveyor belts 7*a* and 7*b* are provided on diverging path 8 similarly to above-mentioned main transport path 6. Banding unit 3 is connected detachably to classifying/stacking unit 2, and conveyor belts 7*a* and 7*b* provided on diverging path 8 are also driven by driving motors other than driving motors for conveyor belts 7*a* and 7*b* provided on main transport path 6.

By the way, on main transport path 6 extending by passing through classifying/stacking unit 2, 21 sensors 31 to 51 are provided for detecting the passing of sheets and monitoring the conveying position and conveying state of sheets. Nine sensors 31 to 39 arrange on main transport path 6 extending by passing through upper unit 2*a* function as first detecting portions of this invention and 12 sensors 40 to 51 arranged on main transport path 6 extending by passing through lower unit 2*b* functions as second detecting portions of this invention.

Further, on diverging path 8 extending by passing through banding unit 3, five sensors 52 to 56 are provided to function as third detecting portions of this invention. Sensors 31 to 56 are almost in the same structure and therefore, sensor 31 provided at the most upper stream side along main transport path 6 will be explained here as a representative sample.

FIG. 2 is a side view of sensor 31 viewed from one side of main transport path 6, and FIG. 3 is a sectional view of sensor 31 and 3 sets of conveyor belts 7*a* and 7*b*. Sensor 31 has 2 sets of light emitting portion 31*a* and light receiving portion 31*b* with main transport path 6 put between. Light emitting portion 31*a* and light receiving portion 31*b* are attached to supporter 31*c* that is made of slender bent plate shape material. At the specified positions of supporter 31*c*, holes 31*d* are formed for beam L emitted from each light emitting portion 31*a* to light receiving portion 31*b* to pass through. Sensors 31 are located at the positions where two beams L to cross main transport path 6 at two positions separated in the width direction of sheets and not interfere 3 sets of conveyor belts 7*a* and 7*b*.

Figure 4A:
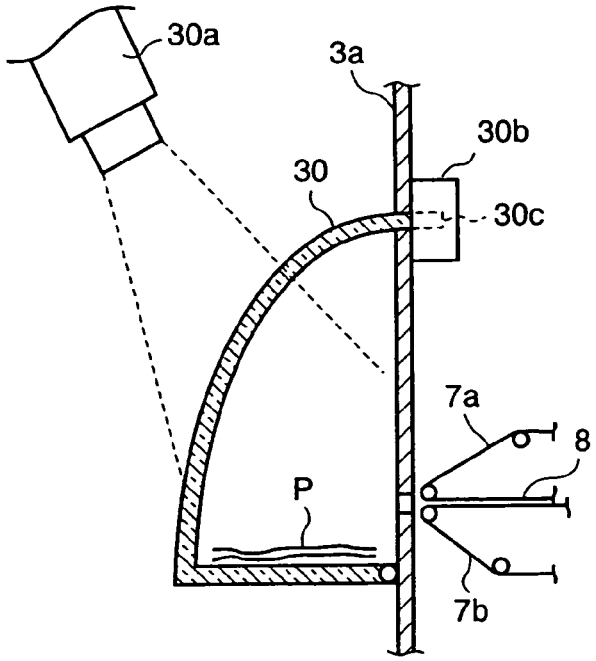
FIGS. 4A and 4B are cross sectional views showing different states of a safety pocket installed in the sheet processing apparatus shown in FIG. 1.
Figure 4B:
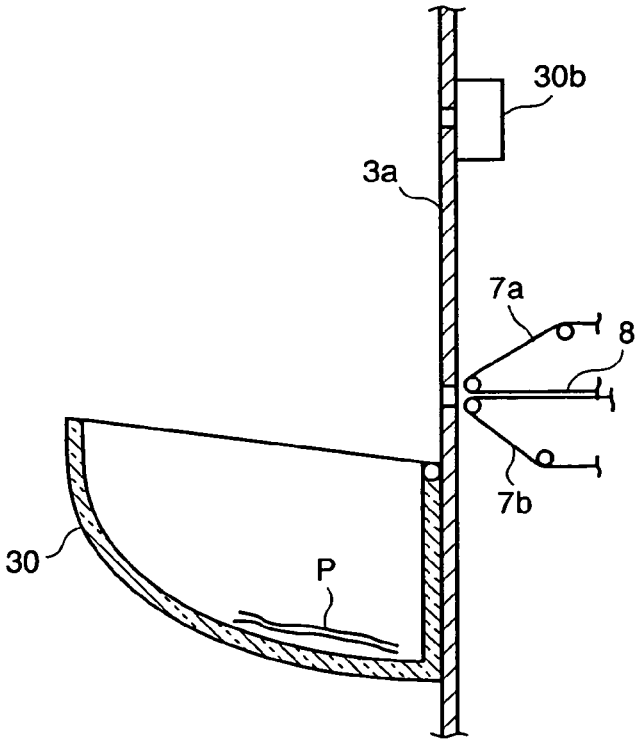

FIGS. 4A and 4B are cross sectional views showing different states of the schematic structure of partially enlarged above-mentioned safety pocket 30. FIG. 4A shows the closed state of safety pocket 30 and FIG. 4B shows the opened state of safety pocket 30. Safety pocket 30 is attached to the sidewall of banding unit 3 through a hinge mechanism so as to be able to open or close.

Safety pocket 30 is formed with a transparent material such as plastic and in the closed state as shown in FIG. 4A, the inside of the pocket can be visually seen. In this embodiment, monitor camera 30*a* is arranged aslant above safety pocket 30 to constantly monitor its inside state.

Further, at the inside of side wall 3*a* of banding unit 3 provided with safety pocket 30, open/close sensor 30*b* is provided for detecting the open/close state of safety pocket 30. Open/close sensor 30*b* detects that safety pocket 30 is in the closed state by detecting projection 30*c* of safety pocket 30 in the banding unit 3 through side wall 3*a* in the closed state of safety pocket 30 as shown in FIG. 4A. When sensor 30*b* detects safety pocket 30 in the open state as shown in FIG. 4B, controller 60 controls first driving motor M1 (the first conveying mechanism) for driving conveyor belts 7*a* and 7*b* provided along main transport path 6 in upper unit 2*a*, second driving motor M2 (the second conveying mechanism) for driving conveyor belts 7*a* and 7*b* provided along main transport path 6 in lower unit 2*b* and third driving motor M3 (the third conveying mechanism) for driving conveyor belts 7*a* and 7*b* provided along diverging path 8 in banding unit 3 to stop the operation, respectively.

Sheets that lost destinations when conveyor gate G3 was switched are stacked in safety pocket 30. For example, when conveyor gate G3 is switched to the initial position, that is, the posture to connect main transport path 6 to lower unit 2*b* and upper unit 2*a* is stopped for jamming of sheets, etc., sheets that may possibly be sent into lower unit 2*b* from upper unit 2*a* by inertia are rejected into safety pocket 30 by way of diverging path 8.

Figure 5:
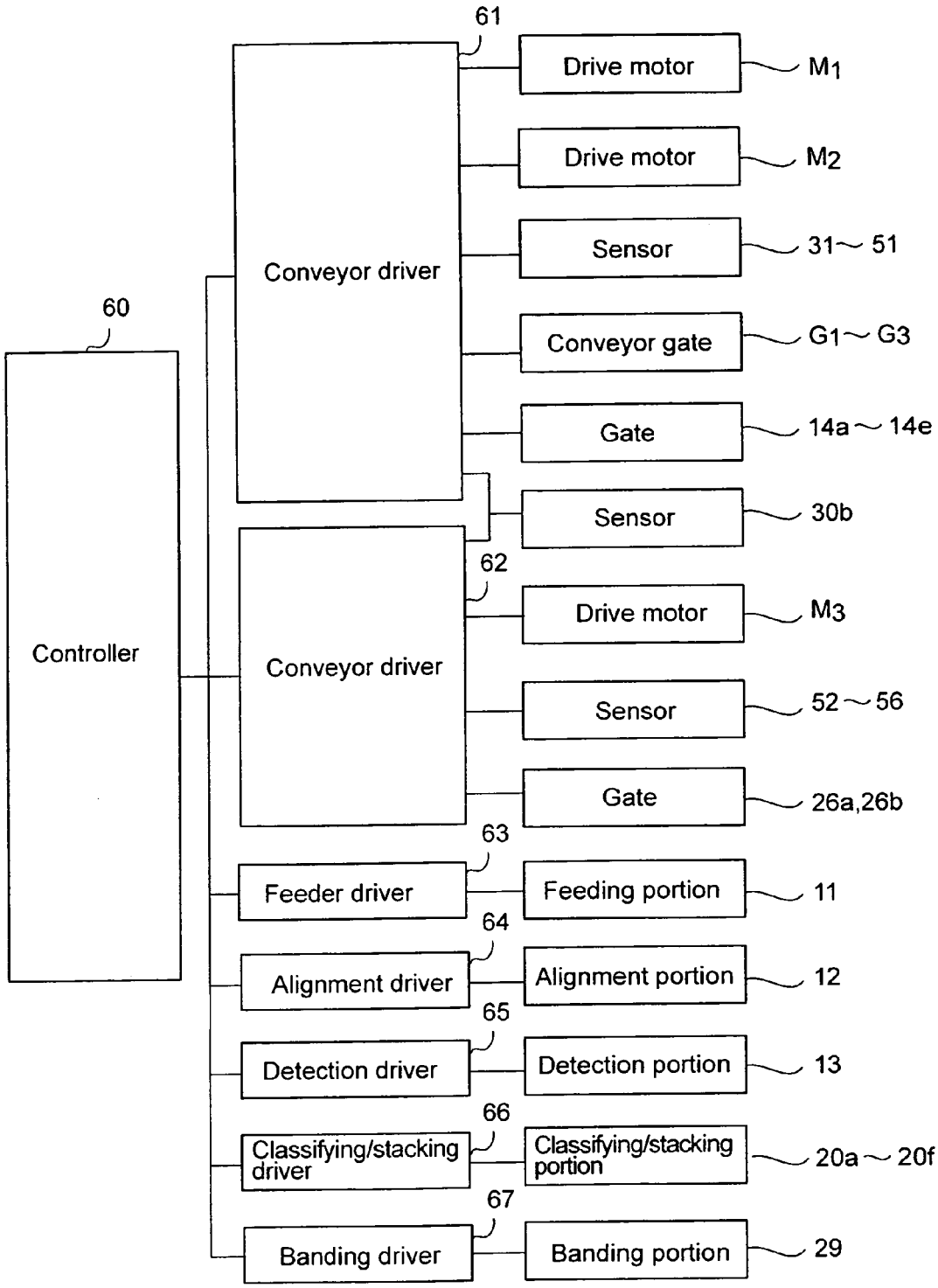
FIG. 5 is a block diagram showing a control system to drive the sheet processing apparatus shown in FIG. 1.

FIG. 5 shows a block diagram of the control system to drive processor 1 described above.

To controller 60 of processor 1, classifying/stacking unit 2, conveyor driver 62 of banding unit 3, feeder driver 63 to drive feeding portion 11, alignment driver 64 to drive alignment portion 12, detection driver 65 to control detection portion 13, classifying/stacking driver 66 to drive classifying/stacking portion 20, and banding driver 67 to driver banding portion 29 are connected.

To conveyor driver 61, first driving motor M1 (the first conveying mechanism) to run plural conveyor belts 7*a* and 7*b* provided along main transport path 6 by passing through upper unit 2*a*, and second driving motor M2 (the second conveying mechanism) to run plural conveyor belts 7*a* and 7*b* provided along main transport path 6 extending by passing through lower unit 2*b* are connected. Further, to conveyor driver 61, 21 sensors 31 to 51, 3 conveyor gates G1, G2 and G3, and 5 gates 14*a*, 14*b*, 14*c*, 14*d* and 14*e* are connected.

Further, to conveyor driver 62, third driving motor M (the third conveying mechanism) to run plural conveyor belts 7*a* and 7*b* provided along diverging path 8 extending passing through banding unit 3 are connected. Further, conveyor driver 62 is connected with five sensors 52 to 56 and gates 26*a* and 26*b* provided on diverging path 8.

Figure 6:
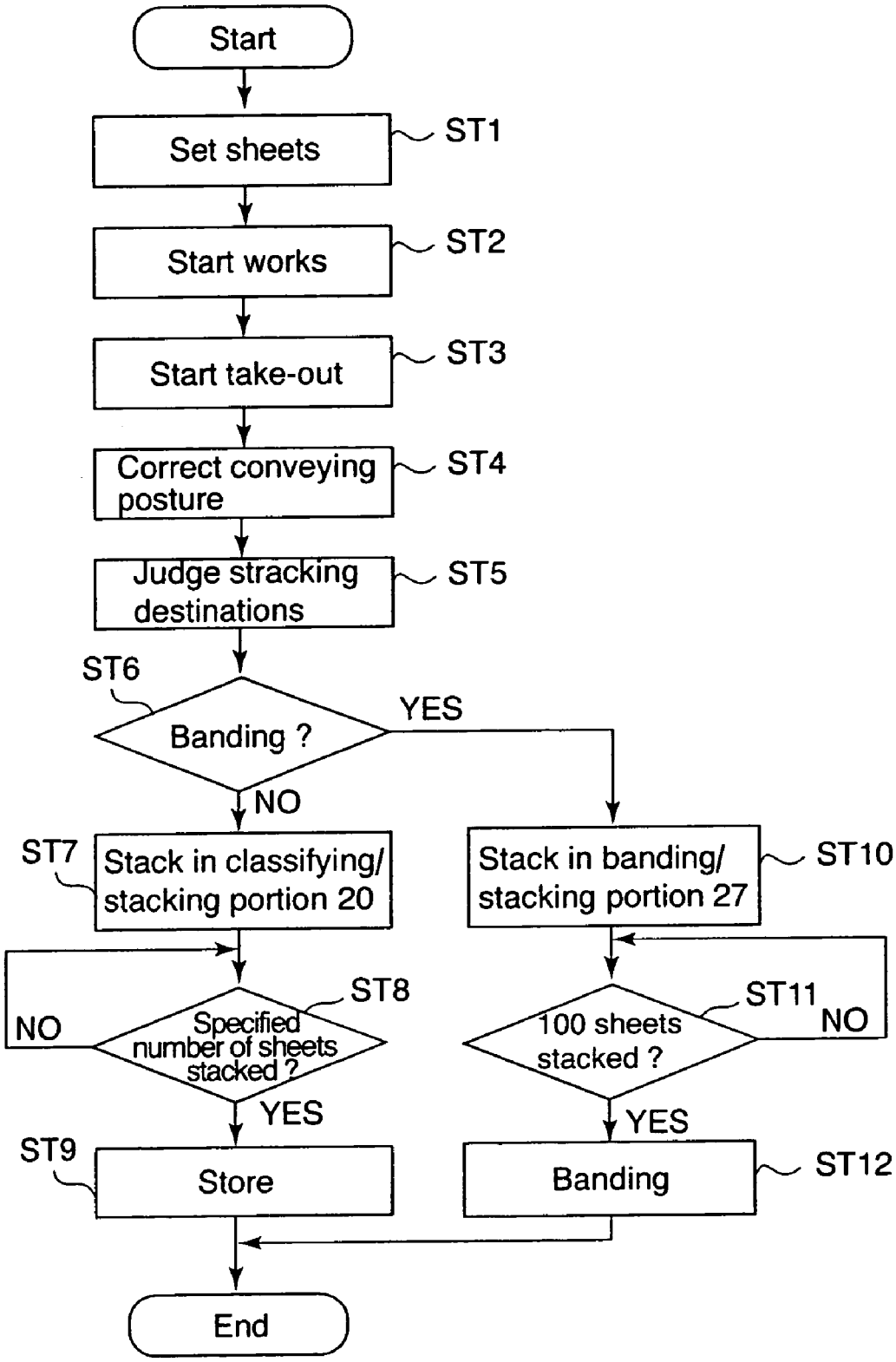
FIG. 6 is a flowchart for explaining the operation of the sheet processing apparatus shown in FIG. 1.

Next, the sheet processing operation by processor 1 in the structure described above will be explained referring to a flowchart shown in FIG. 6.

First, plural sheets that are subject to process are set in feeding portion 11 of upper unit 2*a* (Step 1), the work contents are set through operation/display panel, and the work task based on the set work contents starts (Step 2).

When the work task starts, the sheet feeding operation starts and plural sheets are taken out sequentially on main transport path 6 (Step 3). The sheets taken out on main transport path 6 pass through alignment portion 12 and the conveying posture is corrected (Step 4). Then, various characteristic amounts are read by detection portion 13 and stacking portions in which sheets are to be stacked are judged by controller 60 (Step 5).

Sheets assigned to classifying/stacking portion 20 for stacking (Step 6: NO) are classified and stacked in classifying/stacking portion 20 by selectively switching gates 14*a* to 14*d* based on the work content that is set through operation/display panel 4 and the result of detection by detecting portion 13 (Step 7). Then, when specified number of sheets are stacked in temporal stacking portion 21 (Step 8: YES), the number of sheets is counted, shutter 22 is opened, pusher 24 is operated and stacked sheets are stored in corresponding cassettes 23 (Step 9).

On the other hand, sheets assigned with stacking portion 27 for stacking (Step 6: YES) are classified and stacked in specified stacking portions 27*a* and 27*b* by selectively switching conveyor gate G3 and gates 26*a* and 26*b* (Step 10). When 100 sheets are stacked in each stacking portion 27*a* and 27*b* (Step 11: YES), the counted 100 sheets are confirmed and are supplied to banding portion 29 and banded with a paper strip (Step 12).

Next, the process when the conveying sheets are jammed in processor 1 described above will be explained referring to flowcharts shown in FIG. 7 to FIG. 10. In this embodiment, when conveying sheets are jammed in upper unit 2*a*, the process is continued basically by lower unit 2*b* and banding unit 3, and when the conveying sheets are jammed in lower unit 2*b*, the process is continued by lower unit 2*b*.

Figure 7:
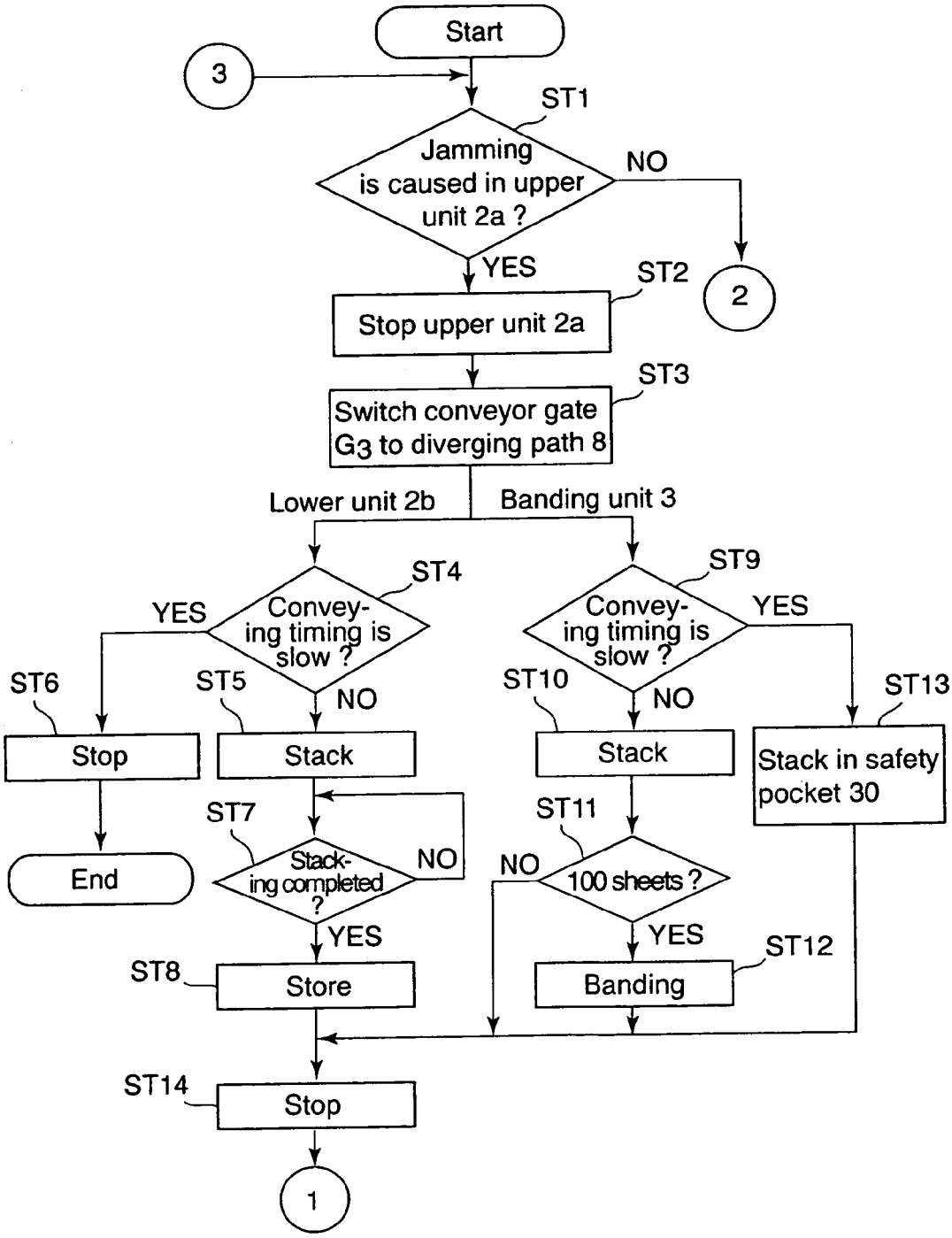
FIG. 7 is a flowchart for explaining the jam processing operation in the sheet processing apparatus.
Figure 8:
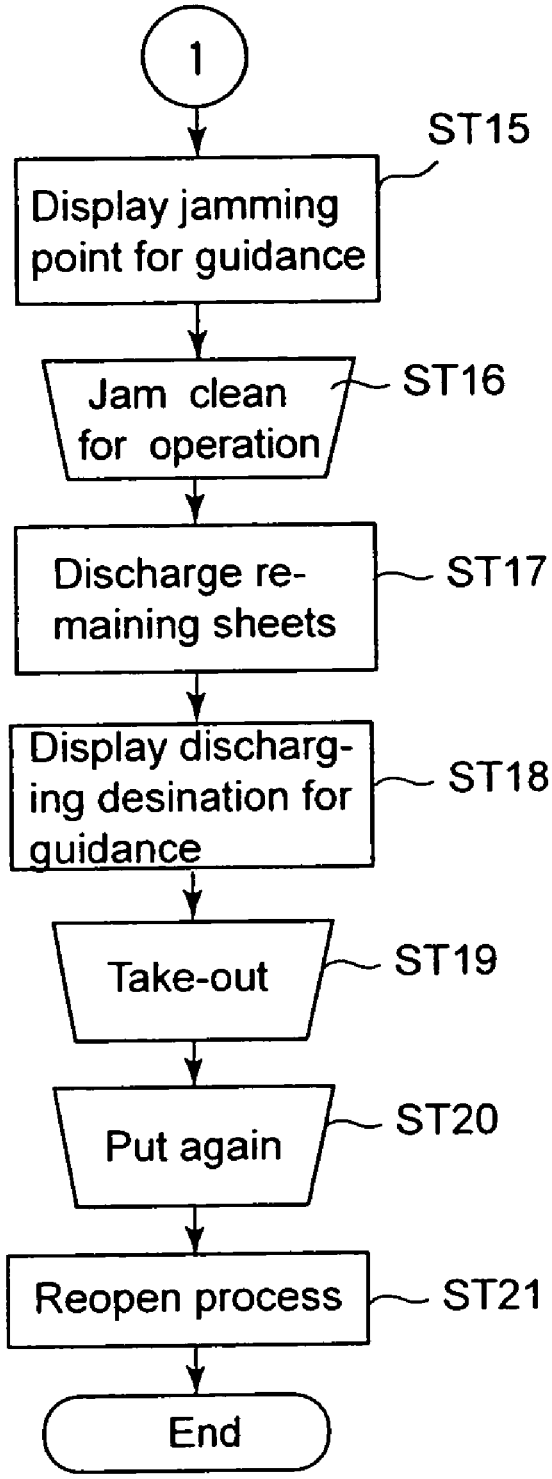
FIG. 8 is a flowchart for explaining the jam processing operation in the sheet processing apparatus shown in FIG. 1.
Figure 9:
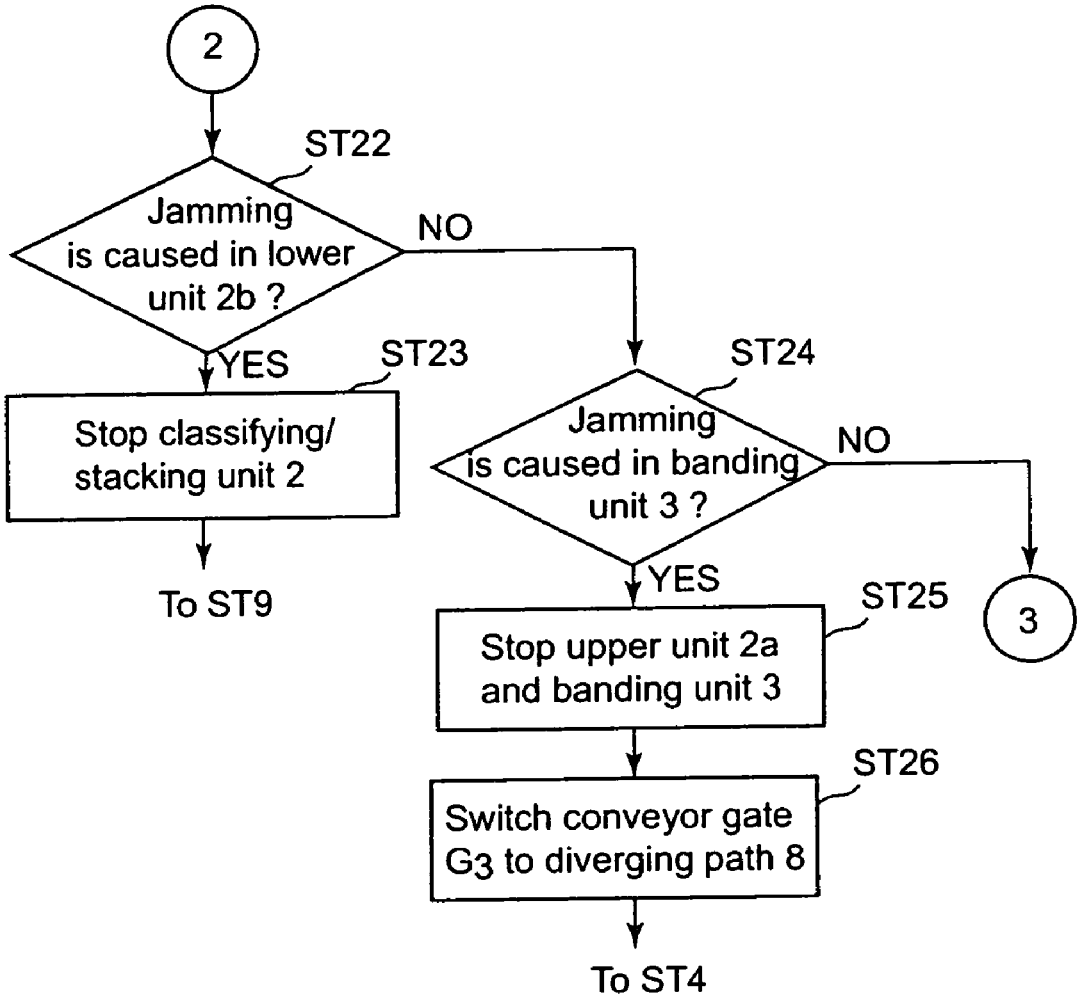
FIG. 9 is a flowchart for explaining the jam processing operation in the sheet processing apparatus shown in FIG. 1

When the jamming of conveying sheets is detected at least by one of sensors 31 to 39 (the first detecting portion) provided on main transport path 6 (including reversing transport path 6*a* and bypass transport path 6*b*) extending through upper unit 2*a* (FIG. 7; STEP 1: YES), controller 60 judges that conveying sheets are jammed in upper unit 2*a*.

In this case, controller 60 stops the sheet conveying in upper unit 2*a* by stopping feeding portion 11 and driving motor M1 (Step 2), and at the same time, connects main transport path 6 to diverging path 8 by switching conveyor gate G3 (Step 3).

Conveyor gate G3 is arranged at the position where it is able to orient sheets that may be sent to lower unit 2*b* from upper unit 2*a* by inertia of sheets toward diverging path 8 when main transport path 6 is connected to diverging path 8 at the timing described above. That is, at the time when upper unit 2*a* is stopped to operate, even when conveyor gate G3 is oriented to lower unit 2*b*, sheets in upper unit 2*a* are not sent to lower unit 2*b* by inertia. Further, conveyor gate G3 is switched to a posture to connect upper unit 2*a* and lower unit 2*b* in the initial state.

After stopping upper unit 2*a* in Step 2, controller 60 continues the process by lower unit 2*b* and checks the conveying timing of all sheets conveyed in lower unit 2*b* (Step 4). Then, controller 60 stacks sheets conveyed at a normal timing (Step 4: NO) in pre-assigned specified temporal stacking portion 21 (Step 5).

Further, when controller 60 judges that sheets being conveyed is behind the timing in Step 4 (Step 4: YES), controller 60 judges that the sheets being conveyed are in an abnormal state for some reason, and stops lower unit 2*b* by stopping driving motor M2 (Step 6) and completes the process. In this case, after lower unit 2*b* is stopped, all sheets stacked in temporal stacking portion 21 are taken out for re-processing.

Then, after all sheets are stacked din lower unit 2*b* in Step 5 (Step 7; YES), controller 60 stores all sheets stacked in temporal stacking portion in corresponding cassette 23 by operating pusher 24 (Step 8) and completes the process.

Further, controller 60 continues the process of banding unit 3 after stopping upper unit 2*a* in Step 2, checks the conveying timing of all sheets conveyed in banding unit 3 (Step 9) and stacks sheets conveyed at a normal timing (Step 9; NO) in specified stacking portions 27*a*, 27*b* (Step 10). At this time, when the number of stacked sheets reaches 100 sheets (Step 11; YES), controller 60 sends 100 sheets to banding portion 29 for banding with a paper strip (Step 12).

On the other hand, sheets judged to be behind the conveying timing in Step 9 (Step 9; YES) are passed gates 26*a* and 26*b* on diverging path 8 directly and stacked in safety pocket 30 (Step 13).

When the process of all sheets in lower unit 2*b* and banding unit 3 is completed after stopping upper unit 2*a*, controller 60 stops lower unit 2*b* and banding unit 3 (Step 14) and displays a point where the jamming is caused on operation/display panel 4 for guidance (Step 15). On this display for guidance, a jamming point is graphically displayed based on the outputs of plural sensors 31 to 56.

Operator checks this guidance display and executes the jam clean for operation manually (Step 16). In this jamming process, operator removes jammed sheets by opening the cover of upper unit 2*a*.

Thereafter, when operator closes the cover of upper unit 2*a*, controller 60 drives all driving motors M1 to M3 and discharges all sheets remaining in processor 1 (Step 17). At this time, destinations of discharging sheets become rejection box 16 of upper unit 2*a*, temporal stacking portion 21 at the most downstream in the conveying direction of lower unit 2*b* and/or safety pocket 30.

Then, controller 60 displays destinations of sheets on operation/display panel 4 as the guidance for operator (Step 18). Operator checks this display guidance and feeds sheets discharged in temporal stacking portion 21 and/or safety pocket 30 (Step 19).

Sheets thus taken out from processor 1 are put into processor 1 again through feeding portion 11 (Step 20) manually by operator and reprocessed based on an instruction input by operator through operation/display panel (for instance, a start key) (Step 21). At this time, the sheets taken out from processor 1 by operator in Step 16 are also put in processor 1 at the same time.

Further, when the jamming of conveying sheets is detected by sensors 40 to 51 (the second detecting portion) provided on main transport path 6 extending through lower unit 2*b* (Step 22; YES), controller 60 judges that the jamming was caused in lower unit 2*b*. In this case, controller 60 stops driving motors M1, M2 and stops the conveying of all sheets in classifying/stacking unit 2 (upper unit 2*a* and lower unit 2*b*) (Step 23).

Then, controller 60 continues the process of banding unit 3 and shifting to the process in Step 9, checks the conveying timing of all sheets conveyed in banding unit 3 (Step 9). The process hereafter is the same as the process described above and its explanation will be omitted here.

Further, when the jamming of conveying sheets was detected by sensors 52 to 56 (the third detecting portion) provided on diverging path 8 extending through banding unit 3 (Step 24; YES), controller 60 judges that the sheet jamming was caused in banding unit 3. In this case, controller 60 stops driving motors M1, M3 and stops the conveying of all sheets in upper unit 2*a* and banding unit 3 (Step 25) and at the same time, connects main transport path 6 to diverging 8 by switching conveyor gate G3 (Step 26).

Then, controller 60 continues the process by lower unit 2*b* and shifting to the process in Step 4 described above, checks the conveying timing of all sheets conveyed into lower unit 2*b* (Step 4). Hereafter, the process is the same as that described above and therefore, will be omitted here.

As described above, according to this embodiment, when the jamming of conveying sheets is caused in upper unit 2*a*, the processes by lower unit 2*b* and banding unit 3 at the downstream side in the sheet conveying direction are continued. Further, when the jamming of conveying sheets is caused in lower unit 2*b*, the process by banding unit 3 is continued and when the jamming of conveying sheets is caused in banding unit 3, the process by lower unit 2*b* is continued.

It is therefore not necessary to stop the entire apparatus when the jamming was caused as before and remove all sheets on the transport path after stopping the processor. Thus, the processing efficiency can be promoted and workload applied to operator can be reduced.

Further, after removing jammed sheets, sheets remaining in upper and lower units 2*a* and 2*b* can be automatically discharged. Thus, operator is required only to remove jammed sheets only and the number of sheets manually removed by operator in the jamming process can be reduced sharply. Therefore, the number of sheets removed and put in processor 1 again can be reduced and the throughput of the processor can be improved.

Further, when the jamming of conveying sheet is caused in upper unit 2*a* or banding unit 3 and upper unit 2*a* is stopped, sheets that may be conveyed into lower unit by inertia are discharged into safety pocket 30. Thus, the process reliability can be promoted.

Figure 10:
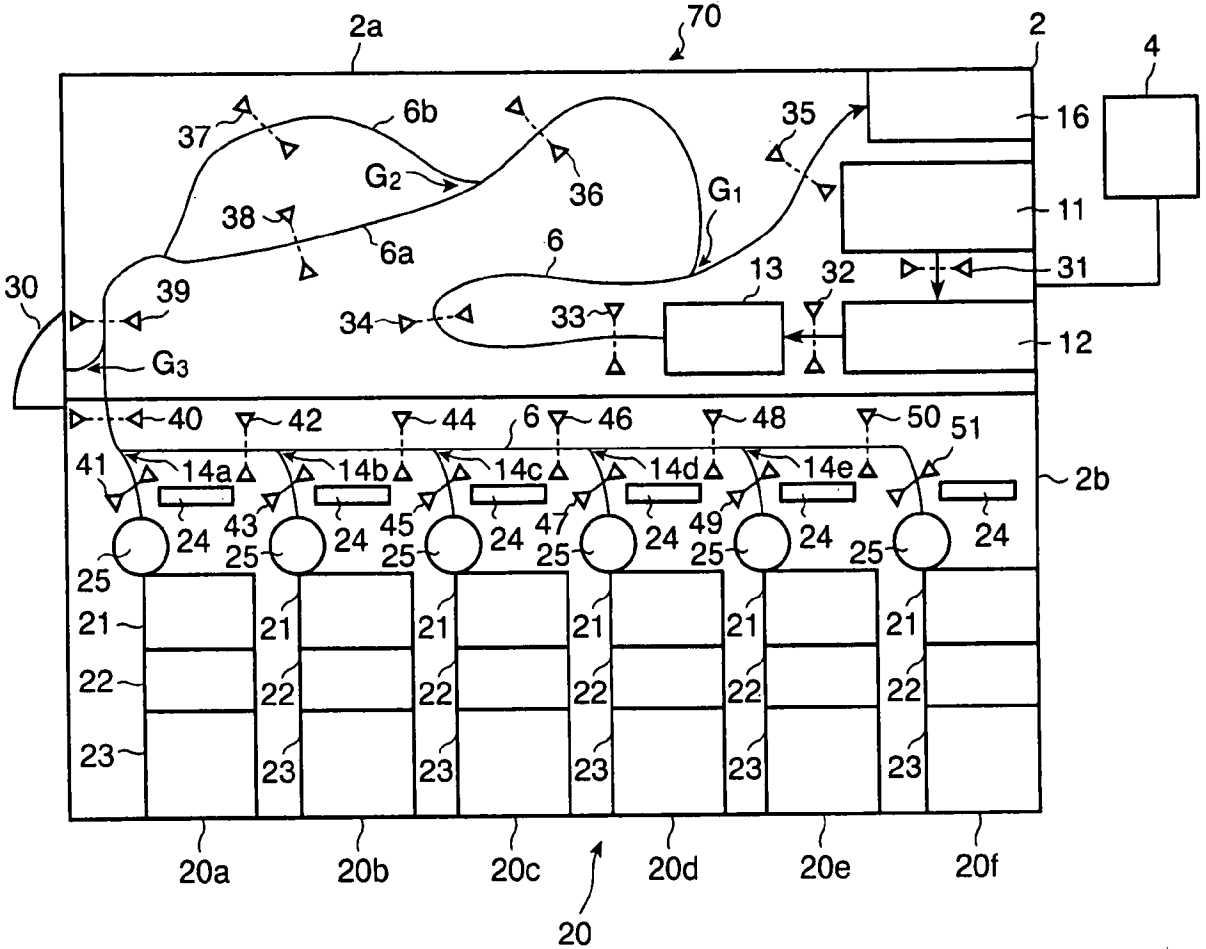
FIG. 10 is a schematic diagram showing the structure of the sheet processing apparatus in a second embodiment of this invention.

FIG. 10 shows the schematic structure of sheet processing apparatus 70 in the second embodiment of this invention. This processor 70 is not provided with banding unit 3 but is equipped with safety pocket 30 in classifying/stacking unit 2. All other portions are the same as those of processor 1 in the first embodiment. Therefore, the component elements that function similarly to those elements of processor 1 are assigned with the same reference numerals.

In this processor 70, when the jamming of conveying sheets is detected through sensors 31 to 39, it is judged that the jamming was caused in upper unit 2*a*, feeding portion 11 is stopped, driving motor M1 is stopped and the sheet conveying by upper unit 2*a* is stopped. At this time, the sheet process by lower unit 2*b* is continued and sheets are stacked in pre-assigned specified temporary stacking portion 21.

As described above, in this second embodiment, when the jamming of conveying sheet is caused in upper unit 2*a* as in the first embodiment described above, the process can be continued without stopping lower unit 2*b* and the same effect as in the first embodiment can be obtained.

Figure 11:
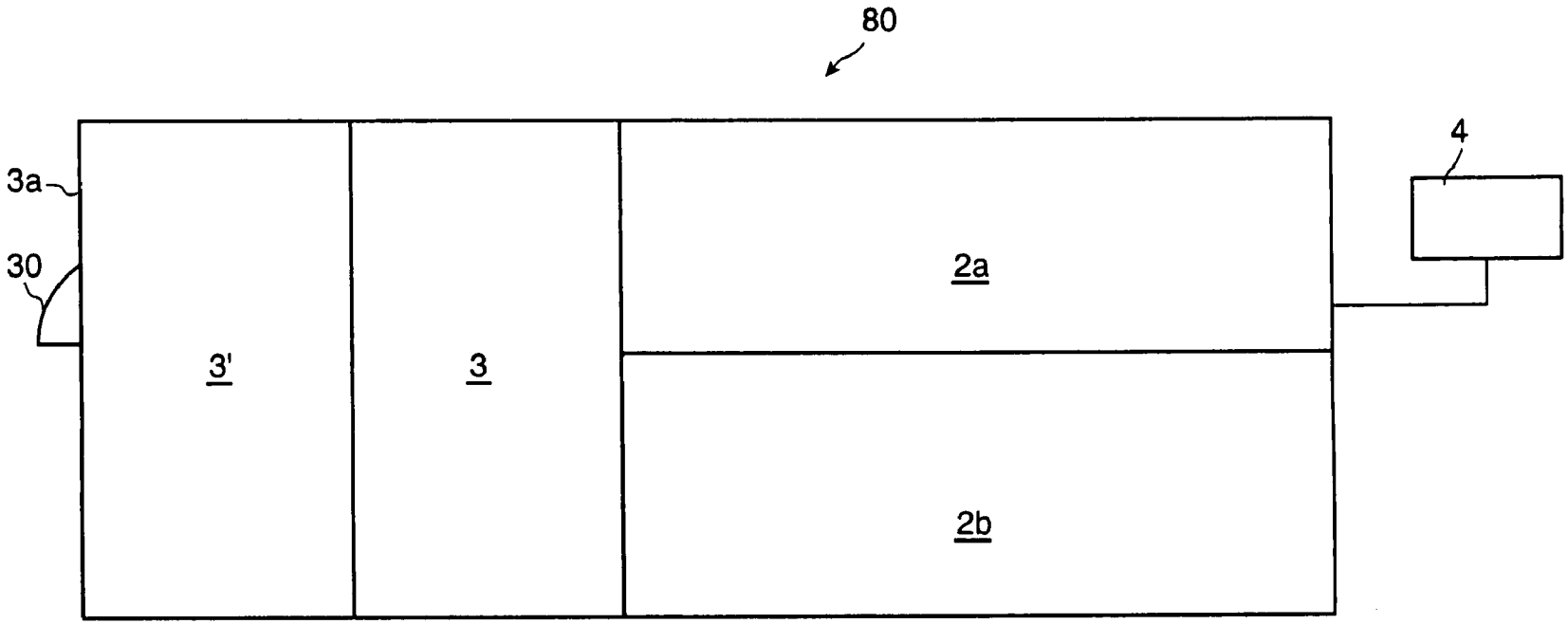
FIG. 11 is a schematic diagram showing the structure of the sheet processing apparatus in a third embodiment of this invention.

FIG. 11 shows processor 80 in the third embodiment of this invention. Here, the internal structures of units 2*a*, 2*b*, 3 and 3' are omitted.

This processor 80 has two banding units 3 and 3' in the same structure arranged side by side along diverging path 8 (not illustrated here) and safety pocket 30 is installed to bending unit 3' at the downstream side in the conveying direction. All other structures are the same as those of processor 1 described above.

In this processor 80, when, for instance, the jamming is caused in banding unit 3 at the upper stream side in the conveying direction, the process in lower unit 2*b* is continued and the process in banding unit 3' of the downstream side in the conveying direction is also continued. Further, when more than 3 banding units 3, 3', 3" . . . are provided, the process by banding units at downstream side in the conveying direction lower than a banding unit wherein the jamming is caused is continued similarly.

As described above, this invention is applicable to processor 80 equipped with plural banding units and the same effect as the embodiments described above can be obtained.

Further, this invention is not restricted to the embodiments described above but can be modified variously within the scope of this invention.

As explained above, the sheet processing apparatus of this invention is in the structure and has functions as described above and is able to make error process such as sheet conveying jam certainly and easily.

What is claimed is:

1. A sheet processing apparatus comprising:

a sheet feeding portion to take out plural sheets on a transport path one by one;

a first unit including the feeding portion;

a second unit connected to the first unit through the transport path;

a first conveying mechanism to convey sheets taken out on the transport path from the feeding portion in the first unit through the transport path;

a second conveying mechanism to receive sheets conveyed from the first unit by the first conveying mechanism and convey in the second unit through the transport path;

a detection portion to detect characteristics of the sheets taken out on the transport path by the feeding portion;

classifying/stacking portions to classify the sheets conveyed to the second unit through the transport path based on the results of detection by the detection portion;

a first detecting portion to detect the conveying state of the sheets conveyed by the first conveying mechanism;

a controller to control the first conveying mechanism to stop thereof when the jamming of sheet is detected by the first detecting portion and control the second unit to classify and stack sheets conveyed to the second unit in classifying/stacking portions;

a rejection portion to diverge and reject sheets that might be conveyed into the second unit from the first unit by inertia from the transport path after the first conveying mechanism is stopped, wherein the rejection portion includes an open/close sensor to detect the open/close state of the rejection portion; and the controller controls the first and second conveying mechanisms to stop the operation thereof when the open/close sensor detects that the rejection portion is in the open state.

* * * * *